US005588242A

United States Patent [19]

Hughes

[11] Patent Number: 5,588,242

[45] Date of Patent: Dec. 31, 1996

[54] GUN BARREL CLEANING ROD AND METHOD

[75] Inventor: Jeffrey T. Hughes, Winston-Salem, N.C.

[73] Assignee: Hughes Products Company, Inc., Thomasville, N.C.

[21] Appl. No.: 625,095

[22] Filed: Apr. 1, 1996

Related U.S. Application Data

[63] Continuation of Ser. No. 391,765, Feb. 21, 1995, abandoned.

[51] Int. Cl.[6] ..... F41A 29/00

[52] U.S. Cl. ..... 42/95; 15/104.066; 15/104.16

[58] Field of Search ..... 42/95; 15/104.066, 15/104.067, 104.16, 104.165, 104.2

[56] References Cited

U.S. PATENT DOCUMENTS

| | | | |
|---|---|---|---|
| 2,236,123 | 3/1941 | Von Pierce | 15/104.16 |
| 3,137,957 | 6/1964 | Ingalls | 42/95 |
| 3,205,518 | 9/1965 | Romaine | 42/95 |
| 3,488,790 | 1/1970 | Satoh | 15/104.165 |
| 4,010,565 | 3/1977 | DiProspero | 42/95 |
| 4,399,627 | 8/1983 | Malesky et al. | 42/95 |
| 4,680,824 | 7/1987 | Lieptz | 42/95 |
| 4,716,673 | 1/1988 | Williams et al. | 42/95 |
| 4,776,125 | 10/1988 | Black et al. | 42/95 |
| 4,889,106 | 12/1989 | Watanabe | 15/104.2 |
| 4,890,406 | 1/1990 | French | 42/95 |
| 5,074,074 | 12/1991 | Yeadon | 42/95 |
| 5,171,925 | 12/1992 | Mekler | 42/95 |
| 5,253,386 | 10/1993 | LaLonde | 15/104.2 |
| 5,297,310 | 3/1994 | Cox et al. | 15/104.2 |
| 5,357,705 | 10/1994 | Stengel | 42/95 |

OTHER PUBLICATIONS

The Random House College Dictionary, Revised Edition. New York: 1980, p. 863.

*Primary Examiner*—Michael J. Carone
*Assistant Examiner*—Theresa M. Wesson

[57] ABSTRACT

A lightweight, portable polymeric gun cleaning rod and method is provided for use having various implements such as brushes, jags, and the like. The cleaning rod shaft is formed from a polymeric composition such as nylon which can be manually worked through the gun barrel during cleaning. A fitting is attached at one end of the shaft for convenient, threadable reception of cleaning implements. After use the cleaning implements can be easily removed and the cleaning rod shaft manually coiled for compact storage.

20 Claims, 2 Drawing Sheets

GUN BARREL CLEANING ROD AND METHOD

This is a continuation of application Ser. No. 08/391,765 filed Feb. 21 1995, now abandoned.

BACKGROUND OF THE INVENTION

1. Field of the Invention

The invention herein pertains to equipment for cleaning shotguns, rifles, and the like and particularly pertains to a lightweight gun cleaning rod which is used with standard barrel cleaning implements.

2. Description of the Prior Art and Objectives of the Invention

Cleaning rods have long been used by hunters, target shooters, and others for cleaning long-barreled weapons such as shotguns, rifles and the like. Conventional cleaning rods consist of metal cylindrical sections which cooperatively engage whereby a plurality of such sections form a convenient length for brushing, swabbing, and oiling gun barrel bores. Conventional metal cleaning rod sections are somewhat inconvenient to use, in that four to six sections have to be joined to obtain the necessary length required. Also, it is not unusual during hunting trips and target practice outings to lose one or more sections of the cleaning rod. Also, conventional cleaning rods can mar or scratch a gun barrel bore, wooden stock, or other surfaces if carelessly handled. Metal cleaning rods may also corrode, causing difficulty in assembly and disassembly.

Thus, with the problems associated with prior art cleaning rods the present invention was conceived and one of its objectives is to provide a lightweight cleaning rod and method which does not require the user to attach a number of sections together.

It is still another objective of the present invention to provide a cleaning rod formed from a polymeric material which will not mar or scratch the internal or external surfaces of a rifle or shotgun.

It is still another objective of the present invention to provide a cleaning rod which can be quickly removed from a storage pouch, attached to a cleaning implement, and inserted into the gun barrel.

It is yet another objective of the present invention to provide a cleaning rod which can be quickly removed from the gun barrel and stored in a compact posture by manually coiling the same.

Various other objectives and advantages of the present invention will become apparent to those skilled in the art as a more detailed description is set forth below.

SUMMARY OF THE INVENTION

A gun cleaning rod is provided for shotguns, rifles, and the like having a cylindrically shaped shaft formed from a polymeric material such as a suitable nylon, polypropylene, or the like. The cleaning rod shaft may have, for example, a threaded fitting crimped on one end to receive various cleaning implements such as brushes, jags, adapters, or the like. In use, the cleaning rod is inserted into the barrel of the gun where it assumes a substantially linear posture and has enough rigidity to allow manual urging of a tight-fitting brush or the like though the barrel bore. After the cleaning rod has been used, it can be withdrawn from the barrel bore, the selected cleaning implement removed, and the shaft coiled and returned to a small convenient storage pouch or the like where it remains until its next use. The polymeric material will not rust or corrode and is lightweight for ease in handling.

DETAILED DESCRIPTION OF THE PREFERRED EMBODIMENT OF THE INVENTION

Figure 1:
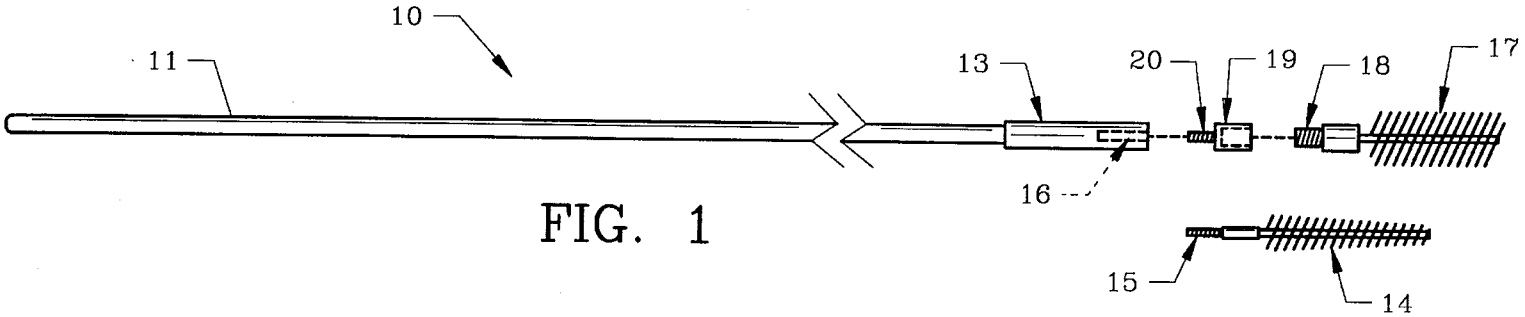
FIG. 1 illustrates the cleaning rod shaft of the invention with a pair of different size brushes in exploded fashion.
Figure 2:
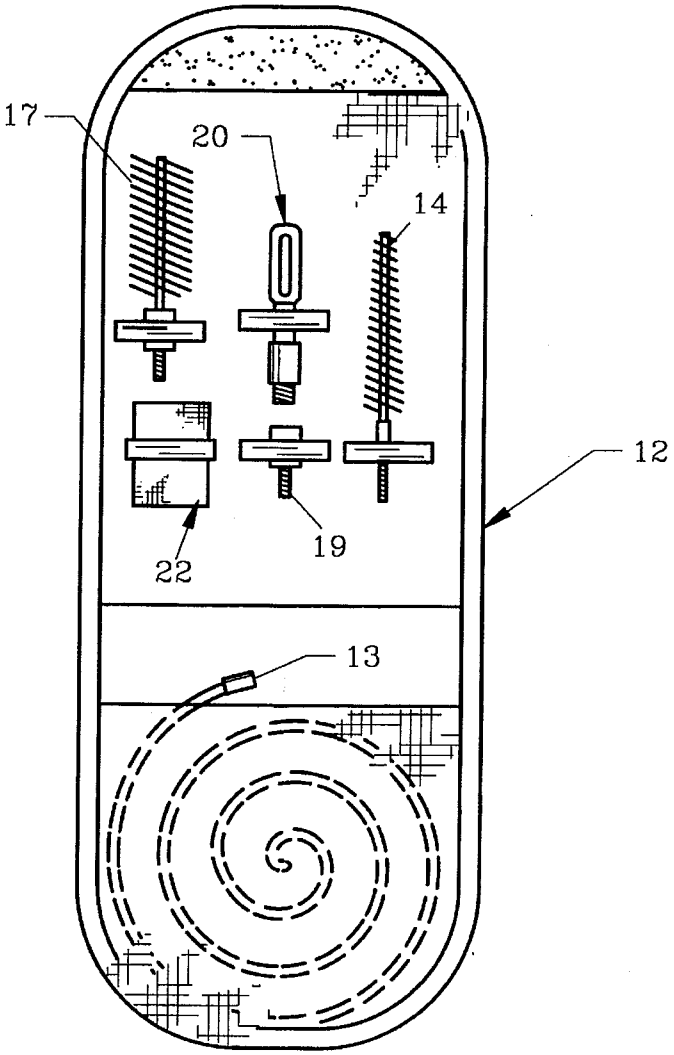
FIG. 2 shows a conventional belt type fabric pouch for transporting the cleaning rod and implements.

The preferred form of the invention and its method of use are shown in FIGS. 1–4 whereby coilable gun barrel cleaning rod 10 is shown in FIG. 1 in a linear or "uncoiled" posture whereas in FIG. 2 cleaning rod shaft 11 is shown in coiled form for storage purposes. Shaft 11 is formed from a flexible, polymeric material such as nylon, polypropylene or other suitable composition. Polymeric materials have been found to be especially adaptable for the purpose demonstrated herein since they do not scratch or mar the gun barrel, stock, or other surfaces they may contact. Coilable shaft 11 as seen in FIG. 1 may be cylindrically shaped with a 0.2 inch (5.08 mm) diameter and extend for approximately 32 inches (812.8 mm). Shaft 11 can be coiled to form 2–4 convolutions for compact storage such as in pouch 12 shown in FIG. 2.

Figure 3:
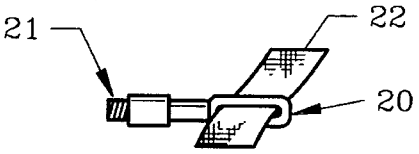
FIG. 3 demonstrates the cleaning jag fitted with a cloth patch.

Fitting 13 is also shown in FIG. 1 consisting of a metal member crimped onto the end of shaft 11 and having internal threads. As further seen in FIG. 1, bore brush 14 includes a threaded section 15 for directly engaging internal threads 16 of fitting 13. Bore brush 14 may be useful for a barrel bore of 30 caliber size. Bore brush 17, also seen has a larger diameter than brush 14 and can be used, for example, in cleaning a 12-gauge shotgun barrel. Threaded section 18 of brush 17 is too large to directly engage internal threads 16 of fitting 13 and requires adapter 19 for use. Adapter 19 may be formed of metal and includes larger internal threads and a rear threaded section 20 which is sized to correctly engage internal threads 16 of fitting 13. Another implement, in addition to brushes 14, 17 is shown in FIG. 3, whereby slotted cleaning jag 20 for retaining cloth patch 22 for oiling the gun barrel is featured, as is conventional in the industry. Cleaning jag 20 also includes threaded section 21 which directly attaches to fitting 13 without the need for an adapter.

Figure 4:
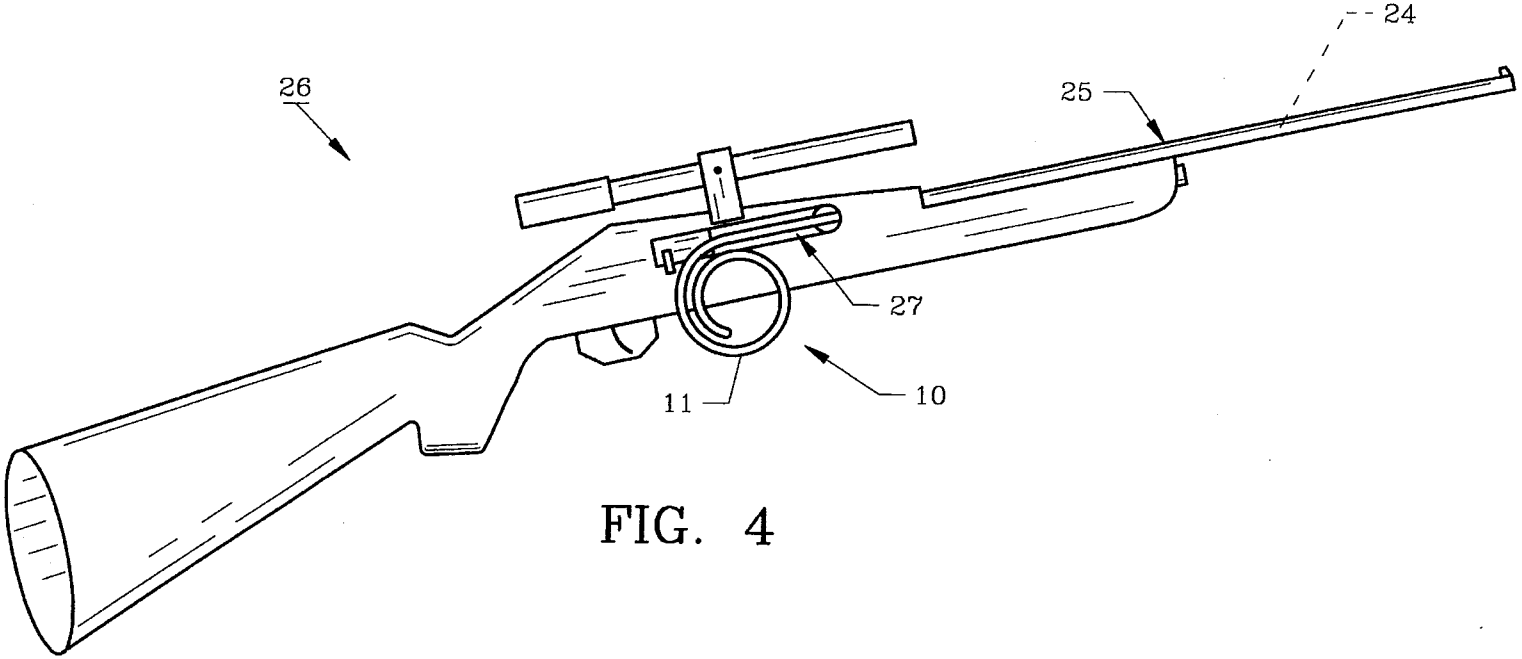
FIG. 4 depicts the insertion of the cleaning rod through the breech into the rifle bore of a conventional rifle.

The preferred method of using coilable gun barrel cleaning rod 10 is illustrated in FIG. 4 whereby shaft 11 is shown partially uncoiled and inserted into breech 27 of rifle 26. Shaft 11, after attachment to a suitable cleaning implement, is inserted into bore 24 of barrel 25 through breech 27. The method consists of removing coiled cleaning rod shaft 11 from its storage position, attaching a suitable cleaning implement thereto such as brush 14, and then passing cleaning rod 10 with brush 14 attached through the barrel of the gun to clean barrel bore 24 of any excess powder, dust, debris, or the like therefrom. After cleaning has been accomplished, brush 14 can be removed and cleaning jag 20 threadably attached for receiving oiled cloth patch 22. Cloth patch 22 is passed through barrel 25 and thereafter, patch 22 discarded and jag 20 removed from shaft 11. Cleaning rod shaft 11 can then again be coiled and returned to its storage position, in pouch 12 or the like, along with jag 20, and shaft 11 manually re-coiled for storage. Polymeric shaft 11 can be used without fear of scratching or otherwise harming barrel 25.

Coil 11 is preferably formed of a conventional polymeric material which will conveniently allow 2–4 convolutions of 6 inches (152.4 mm) or less in diameter for convenient storage as shown in FIG. 2. Suitable polymers for shaft 11 have been found to include nylon and polypropylene, although other polymers or materials may likewise be used provided they exhibit the necessary characteristics and will not harm nor scar the gun surfaces, and will also provide enough rigidity during use to allow the movement of a tight-fitting brush through the gun barrel bore when manually urged.

The illustrations and examples provided herein are for explanatory purposes and are not intended to limit the scope of the appended claims.

I claim:

1. A gun barrel cleaning rod comprising: a coilable, uniformly flexible, wholly polymeric shaft, and a cleaning implement, said cleaning implement affixed to said polymeric shaft, said polymeric shaft having rigidity sufficient to overcome compression forces encountered while said cleaning implement is urged tightly through said gun barrel.

2. The gun barrel cleaning rod of claim 1 and including a rigid fitting, said fitting affixed to one end of said polymeric shaft, said fitting for maintaining said cleaning implement on said polymeric shaft.

3. The gun barrel cleaning rod of claim 2 wherein said fitting is threaded.

4. The gun barrel cleaning rod of claim 1 wherein said polymeric shaft can be coiled into at least one (1) convolution.

5. The gun barrel cleaning rod of claim 1 wherein said polymeric shaft is formed from nylon.

6. The gun barrel cleaning rod of claim 1 wherein said polymeric shaft is formed from polypropylene.

7. The gun barrel cleaning rod of claim 1 wherein said cleaning implement comprises a brush.

8. The gun barrel cleaning rod of claim 1 and including a shaft adapter, said adapter for attachment to said polymeric shaft.

9. A gun barrel cleaning rod comprising:

(a) a Uniformly coilable shaft, said coilable shaft consisting of a single wholly polymeric cylindrically-shaped shaft;

(b) a rigid fitting, said fitting attached to one end of said coilable shaft; and (c) a cleaning implement, said cleaning implement releasably affixed to said fitting for passing through a gun barrel, said coilable shaft having rigidity sufficient to overcome compression forces encountered while said cleaning implement is urged tightly through said gun barrel.

10. The gun barrel cleaning rod of claim 9 wherein said cleaning implement comprises a brush.

11. The gun barrel cleaning rod of claim 9 wherein said cleaning implement comprises a cloth patch.

12. The gun barrel cleaning rod of claim 9 wherein said coilable shaft is formed from polypropylene.

13. The gun barrel cleaning rod of claim 9 wherein said coilable shaft is formed from nylon.

14. The gun barrel cleaning rod of claim 9 wherein said rigid fitting is formed from metal.

15. The gun barrel cleaning rod of claim 9 wherein said shaft has a thickness of approximately 5 millimeters.

16. A method of cleaning a gun barrel with a uniformly flexible, wholly polymeric cleaning rod shaft having rigidity sufficient to overcome compression forces encountered while a cleaning implement attached to said rod is urged tightly through said gun barrel, comprising the steps of:

(a) uniformly uncoiling the cleaning rod shaft into a suitably linear form, (b) passing the cleaning rod shaft through the gun barrel to remove debris therefrom, and (c) thereafter removing the cleaning rod shaft from the gun barrel.

17. The method of claim 16 and including the steps of uniformly coiling the cleaning rod shaft after removal from the gun barrel, and placing the uniformly coiled rod into a pouch.

18. The method of claim 16 wherein passing the cleaning rod shaft through the gun barrel comprises passing the cleaning rod shaft through the breech of the gun into the gun barrel to remove debris from the gun barrel.

19. The method of claim 16 wherein the step of passing the cleaning rod shaft through the gun barrel comprises the steps of urging said shaft through said gun barrel, encountering compression forces, and overcoming said compression forces.

20. The method of claim 17, wherein uniformly coiling the cleaning rod shaft comprises uniformly coiling the cleaning rod shaft into approximately 3 convolutions.

* * * * *